US006059476A

United States Patent [19]

Brugger

[11] Patent Number: 6,059,476

[45] Date of Patent: May 9, 2000

[54] APPLICATOR

[75] Inventor: Franz Brugger, Friedrichshafen, Germany

[73] Assignee: J. Wagner GmbH, Friedrichshafen, Germany

[21] Appl. No.: 09/151,929

[22] Filed: Sep. 11, 1998

[30] Foreign Application Priority Data

Sep. 29, 1997 [DE] Germany ..... 197 42 888

[51] Int. Cl.[7] ..... B05C 17/02

[52] U.S. Cl. ..... 401/197; 401/188

[58] Field of Search ..... 401/188, 197

[56] References Cited

U.S. PATENT DOCUMENTS

| | | | |
|---|---|---|---|
| 3,826,581 | 7/1974 | Henderson | 401/197 |
| 4,588,318 | 5/1986 | O'Brien et al. | 401/188 |
| 4,599,009 | 7/1986 | Winston | 401/197 |
| 4,692,048 | 9/1987 | Krohn et al. | 401/197 |

FOREIGN PATENT DOCUMENTS

8525264 U of 1985 Germany .

*Primary Examiner*—Charles R. Eloshway
*Attorney, Agent, or Firm*—Pandiscio & Pandiscio

[57] ABSTRACT

In a device (1) for applying fluids (3), consisting of a carrier pipe (11) provided with outlet openings (13), of a paint distributor (21) rotatably mounted on the carrier pipe (11), and of an applicator roller (7) held on the paint distributor (21). The paint distributor (21) is formed by an insert (22) shaped with multiple corners and assembled from a pipe section (23) and ribs (24) which are shaped onto it, with the applicator roller (7) being in contact with the ribs (24). Furthermore, axially aligned notches (27) are in an inside surface of the pipe section (23) and the notches (27) act in conjunction with an outer surface of the carrier pipe (11) to form throttle ducts (28) which are connected to the inner space (12) of the carrier pipe (11). A cavity (29) is provided as a reservoir between adjacent ribs (24) of the insert (22), the cavities being connected to the throttle ducts (28) by means of bores (30) in the pipe section (23). This structure achieves a constantly satisfactory distribution of paint over long periods of operation and permits the paint distributor (21) to be completely cleaned without difficulty within a short time period. Furthermore, the device (1) possesses a low inherent weight so it is possible to work without becoming tired.

9 Claims, 4 Drawing Sheets

Figure 1:
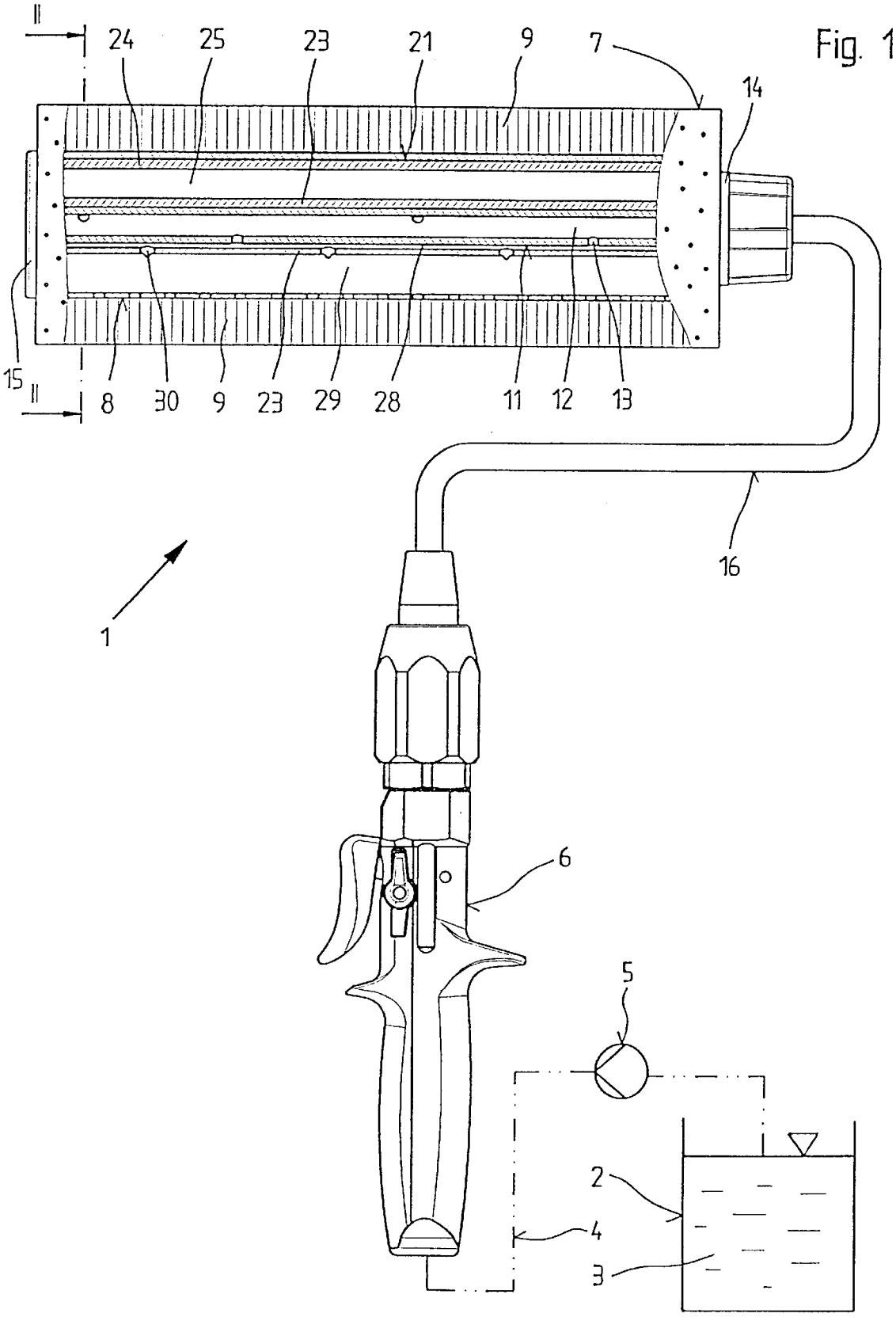

II
24
25
23
21
9
7
14
15
II
8
30
9
23
29
28
11
12
13
16
1
6
5
2
4
3

APPLICATOR

The present invention relates to a device for applying fluids, in particular paint, onto a wall, consisting of a carrier pipe having radially aligned outlet openings which can be connected to a pumping line, of a paint distributor rotatably fixed onto the carrier pipe and of an applicator roller having a perforated support pipe which is held onto the paint distributor.

A pressure-operated applicator roller of this type is familiar from DE 37 19 171 A1. In that instance, the paint distributor is made up of a plurality of modular sections, each of which has a regular polygonal cross-section, enclosing a large inner space and arranged offset at angles the one adjacent to the other. The paint to be supplied to the applicator roller flows out of the inner space of the sections which are clamped together by tie rods, this inner space being connected to the carrier pipe by means of bores, and the paint flows through laterally open slots into external grooves in the adjacent sections and from these to the roller.

Apart from the considerable constructive complexity of this applicator roller which is composed of a large number of components and the considerable time required to assemble the individual sections, a satisfactory supply of paint is frequently not achieved. This is because before paint can be supplied to the roller, the pumping pressure has to force the paint into the individual sections through the bores worked into the carrier pipe which are of a small diameter and, in turn, from the slots in the sections through bores provided in the side walls of the sections into the external grooves of the sections which are in an offset arrangement and adjacent to one another. The bores in the carrier pipe are of a small diameter and act as throttle bores to produce a significant pressure drop; since these frequently become blocked after only a brief period of operation, it is often impossible to prevent individual sections receiving an inadequate supply of paint, thereby leading to a poor distribution of paint. However, the principal disadvantage in this regard lies in the angled configuration of the paint distributor which means it can only be cleaned with difficulty and in a procedure requiring considerable time, whilst due to the large inner space, the procedure entails a considerable loss of paint. Also, since the applicator is completely filled with the components of the paint distributor and by paint, the applicator of prior art has a high inherent weight which makes it difficult to handle.

The purpose of the present invention is consequently to create a device for applying fluids of the aforementioned type in such a way that a satisfactory distribution of paint is achieved constantly throughout a lengthy period of operation. Furthermore, it is intended to achieve a situation in which the paint distributor can be completely cleaned without difficulty and quickly, whilst requiring only a small residual volume of paint to be flushed out. Furthermore, the paint distributor and consequently the device, is to possess a low inherent weight during operation, thus making it possible to work over long periods without becoming tired.

The applicator by means of which this is to be achieved is characterised in that the paint distributor is formed by an insert extending along the axial length of the carrier pipe which is formed with multiple corners and comprises a pipe section which can be pushed onto the carrier pipe and two or more radially protruding ribs formed onto the pipe section, with the support pipe of the applicator roller being in contact with the ribs, that axially aligned notches are worked into the inside jacket surface of the pipe section of the paint distributor and these notches act in conjunction with the outside jacket surface of the carrier pipe to form throttle ducts which are connected to the inner space of the carrier pipe, and that a cavity for accommodating the paint to be processed is provided between each of the adjacent ribs of the insert and these cavities are connected to the throttle ducts by means of radially aligned bores or similar worked into the pipe section.

It is advantageous if the ribs of the insert are formed as high volume air chambers sealed at the end and if each of the notches of the pipe section forming the throttle ducts is arranged between two ribs projecting from the pipe section.

In accordance with another embodiment, the insert may also be composed of individual segments which can be inserted one inside the other, each of which has offset extensions on the one side and recesses accommodating the extensions of the adjacent segment on the other, with the segments being connected together by at least two tie rods inserted into the air chambers of the ribs and supported in end caps, and half of each of the bores provided therein which connect the throttle ducts to the cavities should be worked into two segments which make contact with one another.

If a device for applying fluids is designed in accordance with the present invention, it is always guaranteed that the applicator roller is supplied with sufficient paint along its entire length because the throttle ducts extend along the length of the carrier pipe and the cavities which are provided between the individual ribs and which act as a reservoir are directly connected to one another. Even if one or other of the outlet openings in the carrier pipe were to become blocked, an adequate supply of paint to the cavities and therefore to the applicator roller is still guaranteed nevertheless.

However, the principal benefit derives from the fact that the paint distributor is very simple to clean. Since the throttle ducts are limited by the insert and the carrier pipe, taking out the insert opens up the notches worked into the pipe section which means these notches and the cavities themselves can be cleaned of paint without any problems. The ribs are formed as high volume air chambers and not only do they offer the advantage that the volume of paint remaining in the paint distributor is small, but also the air chambers mean that the weight of the applicator is considerably reduced during the application of paint, because only the cavities of the applicator are filled. The applicator designed in accordance with the proposal can therefore be used over long periods without leading to tiredness and can be serviced easily.

Figure 3:
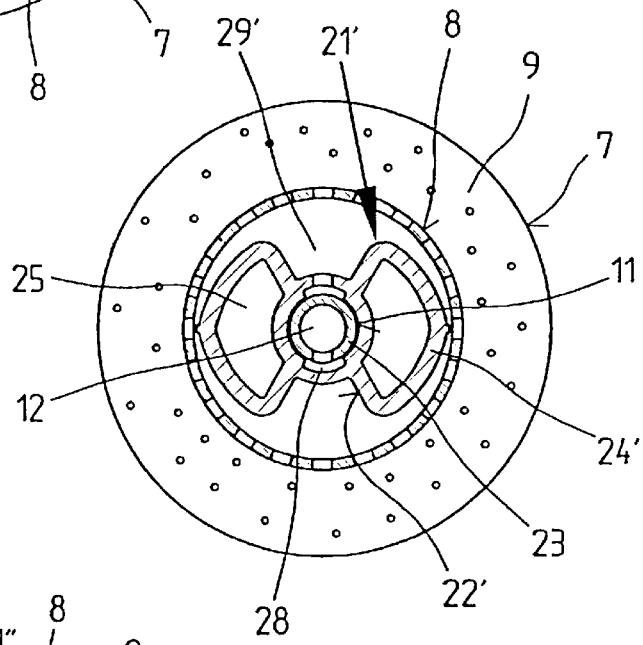
Figure 4:
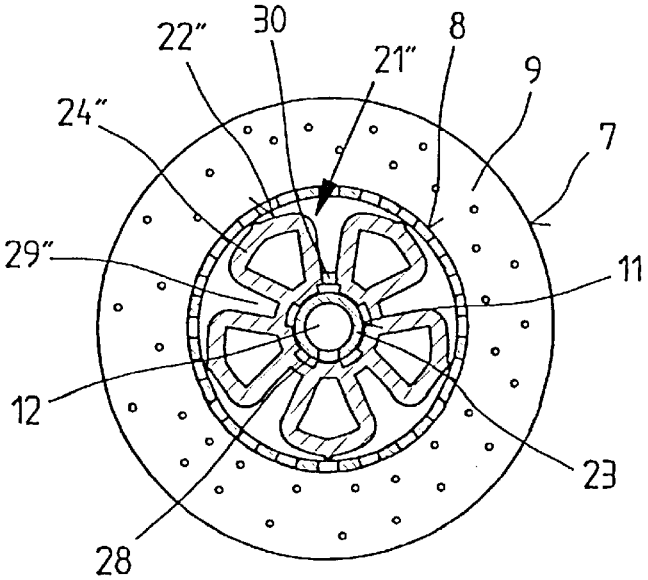
Figure 5:
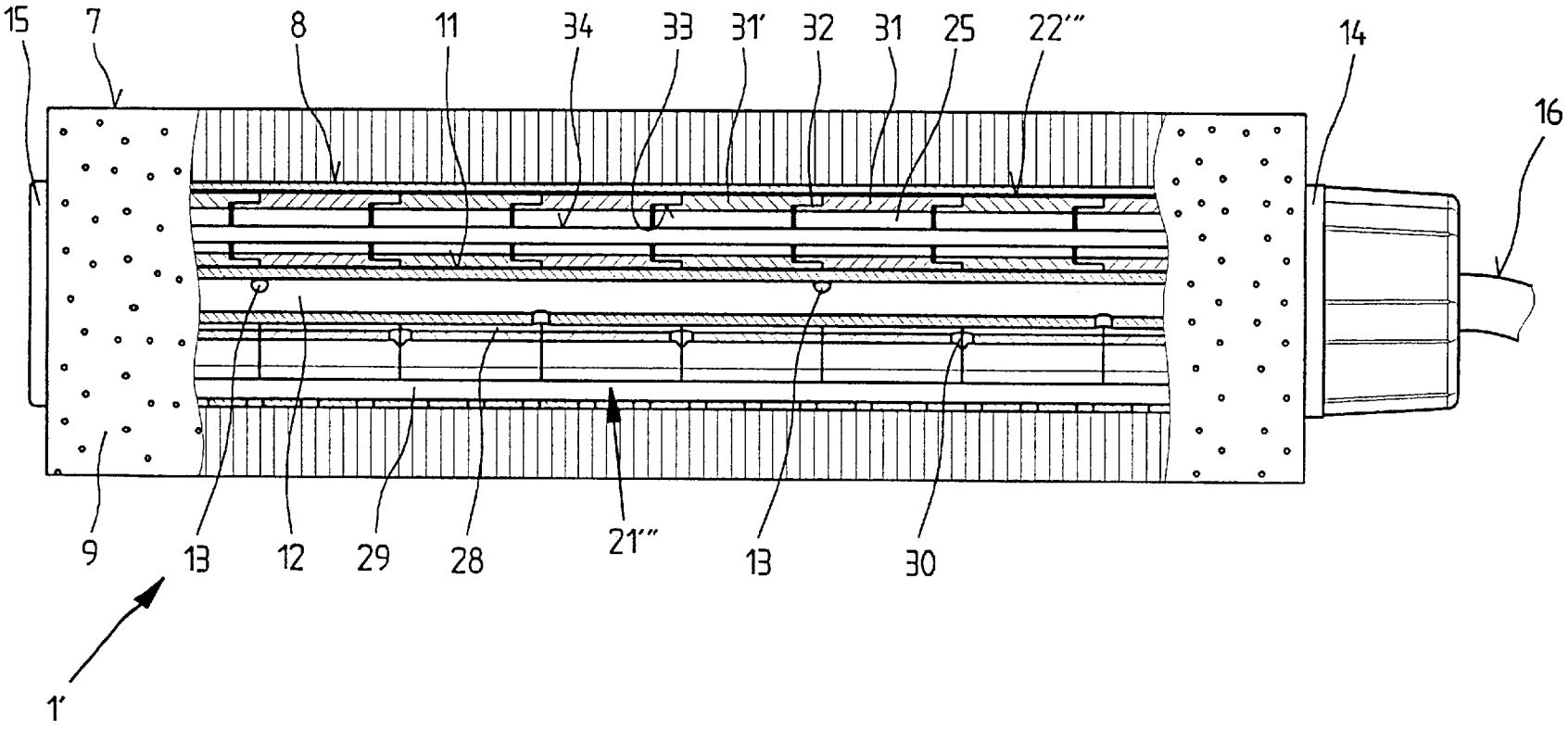
Figure 6:
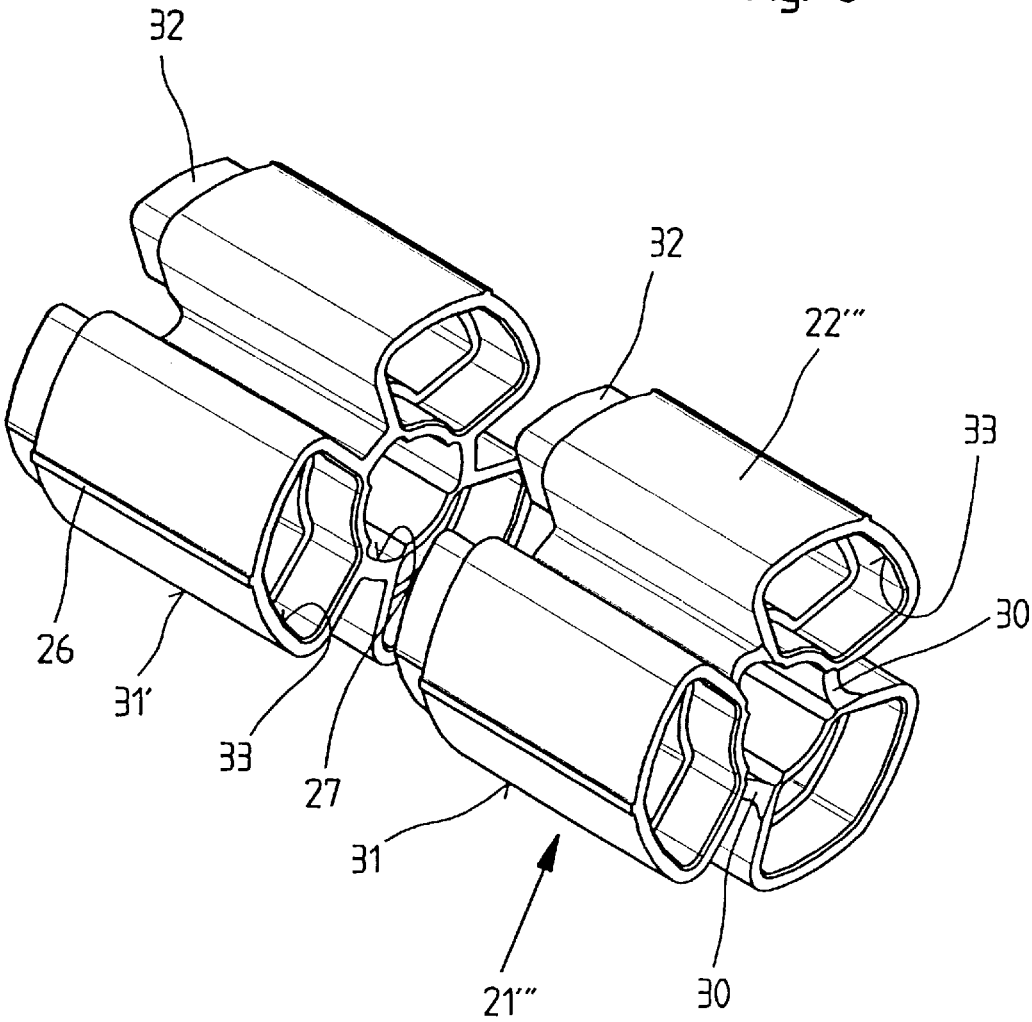

The drawing shows a sample version of the device for applying fluids in accordance with the present invention and explained in detail below. In the drawing, FIG. 1 shows, in a longitudinal section, the applicator connected to a paint pumping line, FIG. 2 shows a section along line II-II in FIG. 1, FIGS. 3 and 4 show different configurations of the paint distributor provided in accordance with FIG. 1, in sectional views in accordance with FIG. 2, FIG. 5 shows, in an axial section, a design variant of the paint distributor provided in accordance with FIG. 1 and FIG. 6. shows, in a perspective view, the paint distributor in accordance with FIG. 5.

The device shown in FIG. 1 and identified by 1 is used for applying fluids, for example paint 3, onto a wall and principally comprises a carrier pipe 11 which can be connected to a pumping line 4, a paint distributor 21 rotatably fixed onto the carrier pipe 11 and an applicator roller 7 made of nonwoven material 9 having a perforated support pipe 8 which is held onto the paint distributor 21. In this case, a pump 5 pumps the paint 3 to be applied from a reservoir 2 into the pumping tube 4 into which is inserted a handle 6 containing a shut-off valve which is not illustrated and which can be opened if required. End caps 14 and 15 clamp the applicator roller 7 onto the carrier pipe 11 to which the handle 6 is attached by means of a bow 16.

Figure 2:
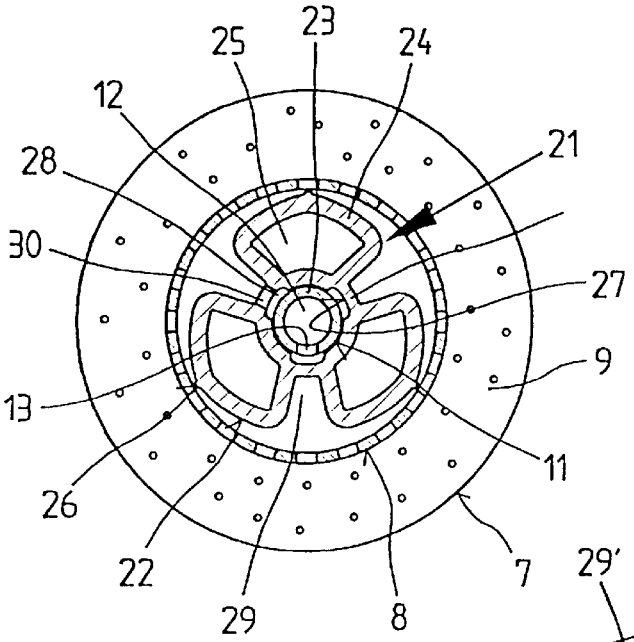

As can be seen from FIG. 2 in particular, the paint distributor 21 consists of the triangular insert 22 which is made up of a pipe section 23 and three protruding ribs 24 formed onto the pipe section 23. In this case, the ribs 24 are formed as high volume air chambers 25 sealed on the end and having centrally arranged contact strips 26 formed on each of their outsides in order to hold the support pipe 8 of the applicator roller 7. Therefore, cavities 29 are created between the ribs 24 and these serve as reservoirs for the paint 3 which is to be applied.

Axially oriented notches 27 are worked into the pipe section 23 of the insert 22 in order to supply the paint to be processed into the cavities 29, with these notches 27 acting in conjunction with the outer jacket surface of the carrier pipe 11 to form throttle ducts 28 which are connected to the inner space 12 of the carrier pipe 11 via outlet openings 13 worked into the carrier pipe 11. Furthermore, radial bores 30 are worked into the pipe section 23 between the ribs 24 so that the pressure built up by the delivery pump 5 can cause the paint 3 to flow from the inner space 12 of the carrier pipe 11 through the outlet openings 13 into the throttle ducts 28 and from these through the bores 30 into the cavities 29.

Since the throttle ducts 28 and the cavities 29 extend along the axial length of the applicator roller 8, it is always guaranteed that the paint 3 to be applied is supplied to the nonwoven material 9 of the applicator roller 7 in an Even and almost non-pressurized flow. Furthermore, the paint distributor 21 and the carrier pipe 11 are easy to clean. Removing the paint distributor 21 from the carrier pipe 11 namely lays open the notches 27 which partially limit the throttle ducts 28 and allows them to be flushed out as well as the smooth carrier pipe 11. Paint residues can also be removed from the insert 22 without any problems since it does not have any recesses. The ribs 24 with their air chambers 25 also result in a situation in which the cavities 29 that fill up with paint 3 are of only a low volume and therefore the inherent weight of the applicator can be kept low during operation.

In the configuration variants shown in FIGS. 3 and 4, the individual sections 22' or 22" of the paint distributor are equipped with two or five ribs 24' or 24" formed onto the pipe sections 23. In this way, the size of the cavities 29' or 29" provided between the ribs 24' or 24" can be varied depending on the purpose to which the applicator is being put.

In the applicator 1' as shown in FIG. 5, the insert 22'" of the paint distributor 21'" is composed of individual segments 31, 31', . . . which are inserted inside one another and are held together by two tie rods 34 which are supported in the end caps 14 and 15 and which pass through the air chambers 25. As can be seen in particular in FIG. 6, in order for the segments 31, 31', . . . to be joined together in a manner which prevents the leakage of fluid, each of the segments 31, 31', . . . has an extension 32 on one end and a recess 33 on the other end which accommodate the insert 32 of the adjacent segment 31 or 31'. Furthermore in this case, half of each of the bores 30 is worked into two adjacent segments 31, 31' so that the bores 30 can be provided at the same time as the segments 31, 31', . . . without special measures having to be taken.

What is claimed is:

1. A device (1) for applying fluids (3), in particular paint, onto a wall said device comprising a non-rotatable carrier pipe (11) having radially extending outlet openings (13) therein and which is adapted to be connected to a pumping line (4), a paint distributor (21) mounted on the carrier pipe (11) for slidably rotating thereon, and an applicator roller (7) having a perforated support pipe (8) which is held on the paint distributor (21), characterised in that the paint distributor (21) is formed by an insert (22) extending along the axial length of the carrier pipe (11) and which is formed with multiple corners and which comprises an annularly configured pipe section (23) having inner and outer walls, and which is rotatable disposed on the carrier pipe (11) and which is provided with two or more radially protruding ribs (24) formed onto the outer wall of said pipe section (23) with the support pipe (8) of the applicator roller (7) being in contact with the ribs (24), the inner wall of the pipe section (23) of the paint distributor (21) defining notches (27), said notches (27) being adapted to act in conjunction with an outside surface of the carrier pipe (11) to form throttle ducts (28) which are in communication with the inner space (12) of the carrier pipe (11), wherein a cavity (29) is provided between adjacent ones of said ribs (24) of the insert (22), the cavities (29) being in communication with the throttle ducts (28) by radially extending bores (30) in the pipe section (23), the cavities (29) extending lengthwise of the paint distributor, each being defined by side surfaces and the pipe section (23) of the ribs (24) and adapted to receive paint from the throttle ducts (28).

2. The applicator in accordance with claim 1, characterised in that, the ribs (24) of the insert (22) are formed as high volume air chambers (25) sealed at the end.

3. The applicator in accordance with claim 1, characterised in that, the notches (27) of the pipe section (23) forming the throttle ducts (28) are each arranged between two ribs (24) projecting from the pipe section.

4. The applicator in accordance with claim 1, characterised in that, the insert (22') is composed of individual segments (31, 31', . . . ) which can be inserted one inside the other, each of which has offset extensions (32) on the one side and recesses (33) accommodating the extensions (32) of the adjacent segment (31') on the other.

5. The applicator in accordance with claim 4, characterised in that the segments (31, 31', . . . ) are connected together by at least two tie rods (34) inserted into the air chambers (25) of the ribs (24), and first and second end caps (13, 14) support said segments.

6. The applicator in accordance with claim 4, characterised in that, in an insert (22'") assembled from segments (31, 31', . . . ), half of each of the bores (30) provided therein which connect the throttle ducts (28) to the cavities (29) is worked into two segments (31, 31', . . . ) which make contact with one another.

7. The applicator in accordance with claim 1, characterised in that, each of the ribs (24) on the outside is provided with a centrally arranged contact strip (26) for holding the support pipe (8) of the applicator roller (7).

8. A device (1) for applying fluids (3), in particular paint, onto a wall, said device comprising a carrier pipe (11) having radially extending outlet openings (13) and which is adapted to be connected to a pumping line (4) of a paint distributor (21) rotatably fixed on the carrier pipe (11), and an applicator roller (7) having a perforated support pipe (8)

which is held on the paint distributor (21), characterised in that the paint distributor (21) is formed by an insert (22) extending along the axial length of the carrier pipe (11) which is formed with multiple corners and which comprises a pipe section (23) which is mounted on the carrier pipe (11) and two or more radially protruding ribs (24) formed onto the pipe section (23), with the support pipe (8) of the applicator roller (7) being in contact with the ribs (24), that axially extending notches (27) are disposed in an inside surface of the pipe section (23) of the paint distributor (21) and the notches (27) act in conjunction with an outside surface of the carrier pipe (11) to form throttle ducts (28) which are connected to the inner space (12) of the carrier pipe (11), and that a cavity (29) for accommodating the paint (3) to be processed is provided between each of the adjacent ribs (24) of the insert (22) and the cavities (29) are connected to the throttle ducts (28) by means of radially extending bores (30) disposed in the pipe section (23), wherein the ribs (24) of the insert (22) are formed as high volume air chambers (25) sealed at ends thereof.

9. A device (1) for applying fluids (3), in particular paint, onto a wall, said device comprising a carrier pipe (11) having radially extending outlet openings (13) and which is adapted to be connected to a pumping line (4), a paint distributor (21) rotatably fixed on the carrier pipe (11), and an applicator roller (7) having a perforated support pipe (8) which is held on the paint distributor (21), characterised in that the paint distributor (21) is formed by an insert (22) extending along the axial length of the carrier pipe (11) and whicn is formed with multiple corners and which comprises a pipe section (23) which is disposed on the carrier pipe (11), and two or more radially protruding ribs (24) formed onto the pipe section (23), with the support pipe (8) of the applicator roller (7) being in contact with the ribs (24), that axially extending notches (27) are disposed in an inside surface of the pipe section (23) of the paint distributor (21) and the notches (27) act in conjunction with an outside surface of the carrier pipe (11) to form throttle ducts (28) which are connected to the inner space (12) of the carrier pipe (11), and that a cavity (29) for accommodating the paint (3) to be processed is provided between each of the adjacent ribs (24) of the insert (22) and the cavities (29) are connected to the throttle ducts (28) by means of radially extending bores (30) disposed in the pipe section (23), wherein the insert (22') comprises individual segments (31, 31', . . . ) which are adapted to be inserted one inside the other, each of which has offset extensions (32) on one side and recesses (33) accommodating the extensions (32) of an adjacent segment (31') on a second side; and wherein in an insert (22''') assembled from segments (31, 31', . . . ), half of each of the bores (30) provided therein which connect the throttle ducts (28) to the cavities (29) is worked into each of two segments (31, 31', . . . ) in contact with one another.

* * * * *